US005120259A

United States Patent [19]

Nakata et al.

[11] Patent Number: 5,120,259

[45] Date of Patent: Jun. 9, 1992

[54] ELECTRICAL CONNECTOR

[75] Inventors: Naohisa Nakata; Kazuhisa Nikaido; Hiroshi Yonemura, all of Tokyo, Japan

[73] Assignee: Hirose Electric Co., Ltd., Tokyo, Japan

[21] Appl. No.: 715,756

[22] Filed: Jun. 14, 1991

[30] Foreign Application Priority Data

Sep. 10, 1990 [JP] Japan ..... 2-9392

[51] Int. Cl.[5] ..... H01R 13/00

[52] U.S. Cl. ..... 439/585

[58] Field of Search ..... 439/578-585, 439/877-882

[56] References Cited

U.S. PATENT DOCUMENTS 4,047,788 9/1977 Forney, Jr. et al. ..... 439/585

FOREIGN PATENT DOCUMENTS 3834172 4/1990 Fed. Rep. of Germany ..... 439/585

*Primary Examiner*—Joseph H. McGlynn

*Attorney, Agent, or Firm*—Kanesaka & Takeuchi

[57] ABSTRACT

A miniature electrical contact terminal (1) for a shielded cable having a central conductor includes a shield jacket (3) including a contact support section (6), a pair of opposed tool openings (10, 11), a shield braid crimping section (7) having crimping tabs for crimping a shield braid of the shielded cable, and an outer sheath crimping section (8) having crimping tabs for crimping an outer sheath of the shielded cable; an insulator block (4) fitted in the contact support section; and a signal line contact (5) having a closed barrel fitted through the insulator block such that a rear portion thereof is placed within the tool openings, whereby the rear portion of the closed barrel, the shield braid crimping section, and the outer sheath crimping section are crimped simultaneously to the central conductor, the shield braid, and the outer sheath of the shielded cable, respectively.

3 Claims, 6 Drawing Sheets

ELECTRICAL CONNECTOR

BACKGROUND OF THE INVENTION

1. Field of the Invention

The present invention relates electrical connectors for shielded cables for use in electronic control units and the like.

2. Description of the Prior Art

FIG. 12 shows a conventional electrical connector of this type. A length of outer sheath g is removed from a shielded cable a to separate a signal line c from a shield braid b. The shield braid b and the signal line c are connected to respective contact terminals e and f of the connector proper d.

In the above conventional electrical connector, however, it is necessary to separately connect the shield braid b and the signal line c to the respective contact terminals e and f, making the mechanization or automation of the wiring operation difficult. In addition, the signal line c is stripped of the shield braid b so that there is little or no shield effect in an area closed to the connector.

SUMMARY OF THE INVENTION

Accordingly, it is an object of the invention to provide a miniature electrical contact terminal having a narrow shield jacket.

According to the invention there is provided a miniature electrical contact terminal for a shielded cable having a central conductor which includes a shield jacket including a contact support section, a pair of opposed tool openings, a shield braid crimping section having crimping tabs for crimping a shield braid of the shielded cable, and an outer sheath crimping section having crimping tabs for crimping an outer sheath of the shielded cable; an insulator block fitted in the contact support section; and a signal line contact having a closed barrel fitted through the insulator block such that a rear portion thereof is placed within the tool openings, whereby the rear portion of the closed barrel, the shield braid crimping section, and the outer sheath crimping section are crimped simultaneously to the central conductor, the shield braid, and the outer sheath of the shielded cable, respectively.

The above and other objects, features, and advantages of the invention will be more apparent from the following description when taken in conjunction with the accompanying drawings.

DESCRIPTION OF THE PREFERRED EMBODIMENT

Figure 13:
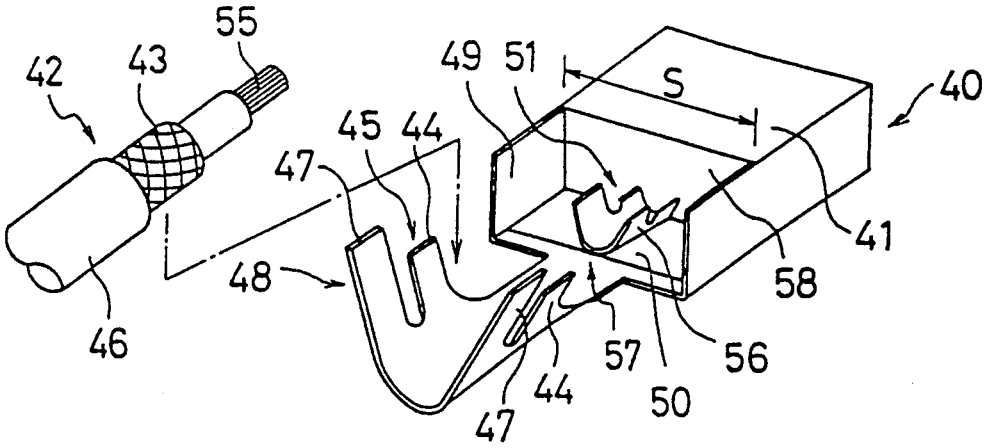
FIG. 13 is a perspective view of an electrical contact terminal according to another embodiment of the invention.

FIG. 13 shows a contact terminal suitable for the automation of the wiring operation and having excellent shield effect. A shield jacket 40 has a rectangular contact support section 41, a U-shaped shield braid crimping section 45 having crimping tabs 44 for crimping the shield braid 43 of a shielded cable 42, a U-shaped outer sheath crimping section 48 having crimping tabs 47 for crimping the outer sheath 46, and a pair of tool openings 49 and 50. A signal line contact 51 has a U-shaped signal line crimping section 57 having crimping tabs 56 for crimping the signal line 55 to the signal line contact 51. A rectangular insulator block 58 is fitted into the contact support section 41 for supporting the signal line contact 51.

Figure 14:
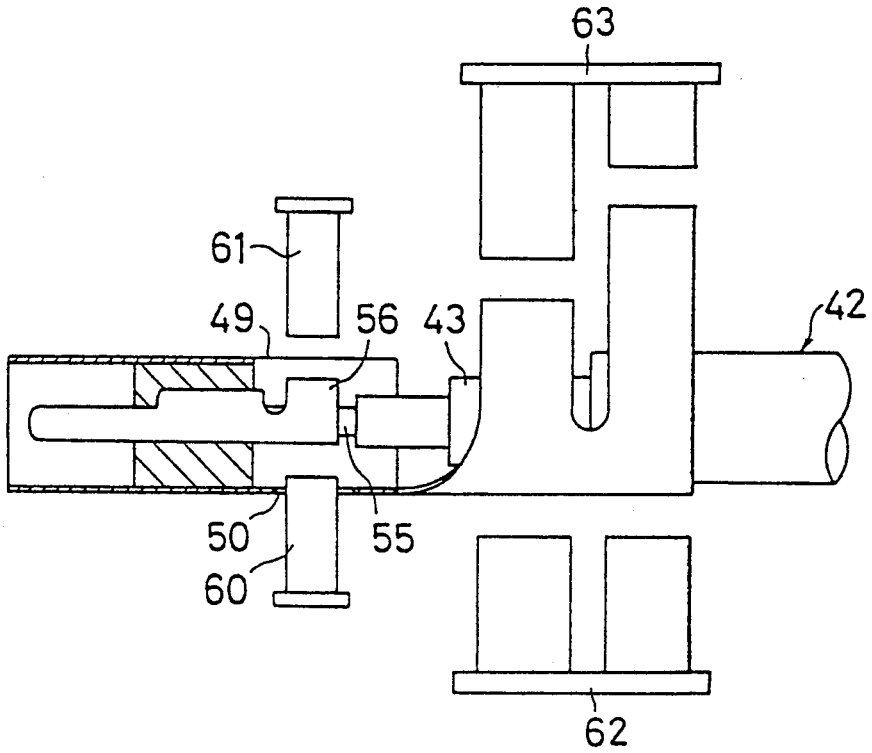
FIG. 14 is a side elevational view of the contact terminal useful for explaining how to connect a shielded cable to the contact terminal; an FIG. 15 is a front elevational view of a crimper die.

In FIG. 14, the stripped front portion of the shielded cable 42 is placed on the contact terminal such that the signal line 55, the shield braid 43, and the outer sheath 46 rest between the respective crimping tabs 56, 44, and 47. A crimping anvil 60 and a crimper die 61 are inserted through the respective tool openings 50 and 49 to crimp the crimping tabs 56 to the signal line 55 while crimping anvil 62 and a crimper die 63 are used to crimp the respective crimping tabs 44 and 47 to the shield braid 43 and the outer sheath 46.

Figure 15:
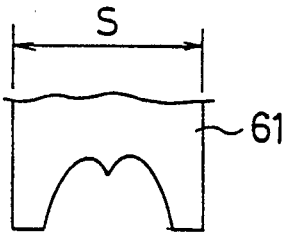

However, since the crimping anvil 60 and the crimper die 61 are so large that it is impossible to reduce the size of the tool opening 49 and the width of the shield jacket 40 below the width S of the crimping die 61 (FIG. 15), putting a limit to the miniaturization of the contact terminal.

Figure 1:
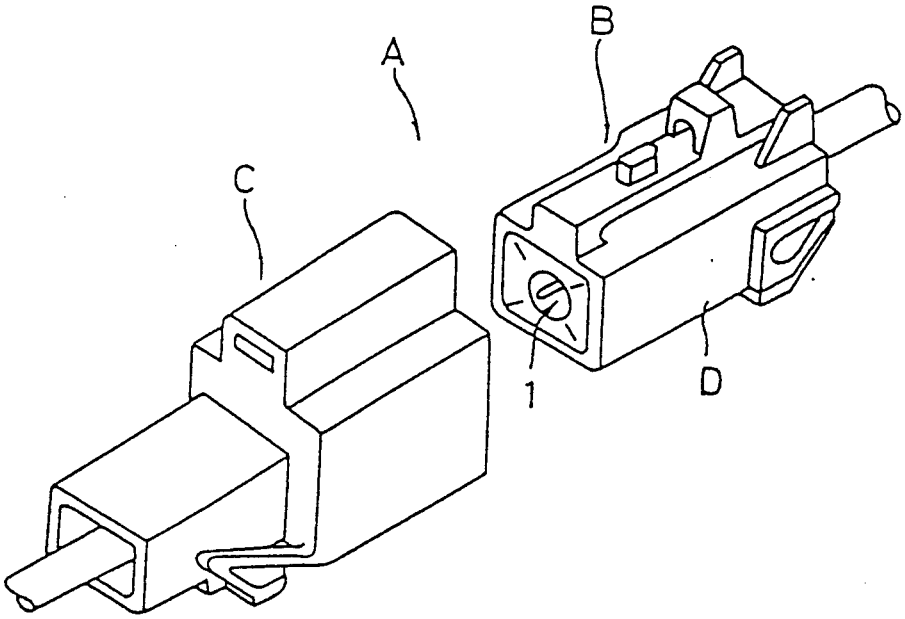
FIG. 1 is a perspective view of an electrical connector using a miniature contact terminal according to an embodiment of the invention.
Figure 12:
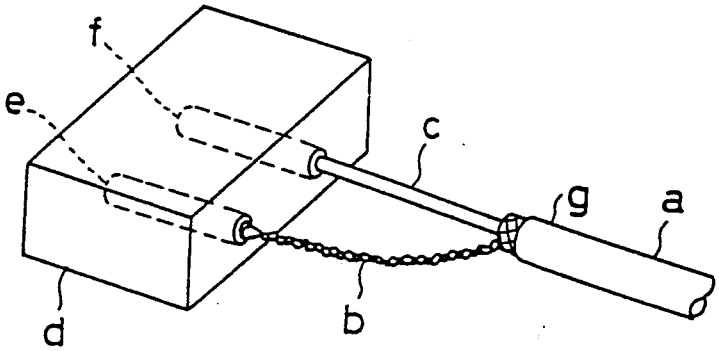
FIG. 12 PRIOR ART
FIG. 12 is a perspective view of a conventional electrical connector.

In FIG. 1, the electrical connector A includes a female connect B and a male connector C. The female connector has a miniature contact terminal 1 therein.

Figure 2:
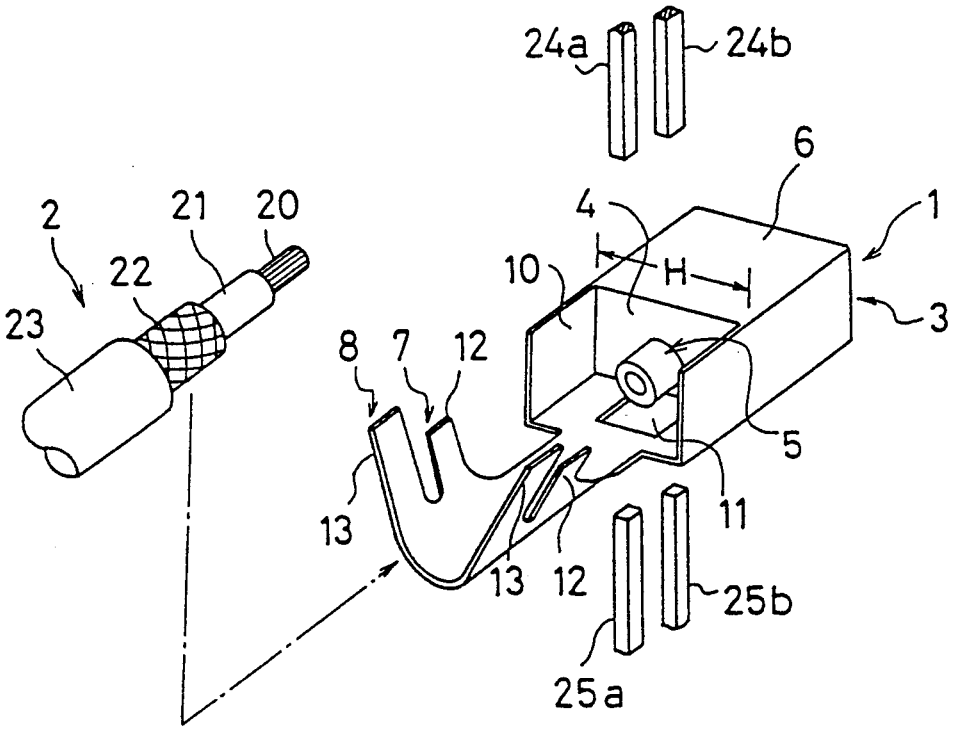
FIG. 2 is a perspective view of the miniature contact terminal.

In FIG. 2, the contact terminal 1 includes a shield jacket 3, an insulator block 4, and a signal line contact 5. The shield jacket 3 includes a rectangular contact support section 6, a U-shaped shield braid (outer conductor) crimping section 7, and a U-shaped outer sheath crimping section 8. A pair of opposed tool openings 10 and 11 are formed behind the contact support section 3. The shield braid crimping section 7 has a pair of crimping tabs 12 while the outer sheath crimping section 8 has a pair of crimping tabs 13, which are made greater than the crimping tabs 12.

Figure 3:
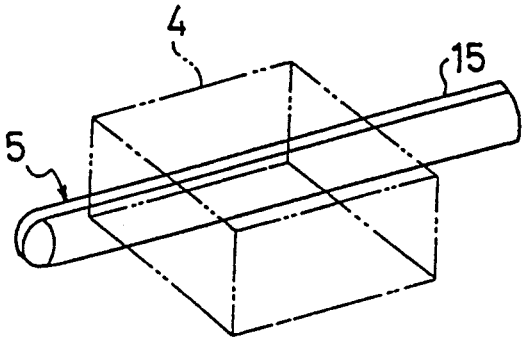
FIG. 3 is a perspective view of a signal line contact useful for the miniature contact terminal.

As FIG. 3 shows, the signal line contact 5 is made in the form of a closed barrel 15. It is supported within the contact support section 6 of the shield jacket 3 with the insulator block 4 to complete a contact terminal 1.

Figure 4:
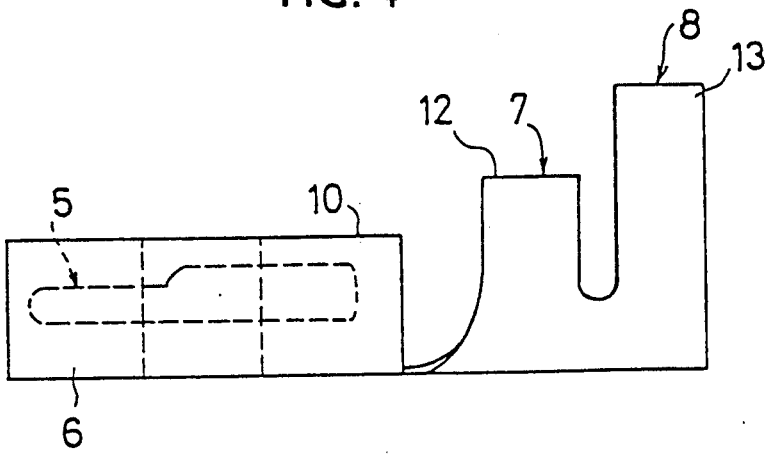
FIG. 4 is a side elevational view of the miniature contact terminal.
Figure 5:
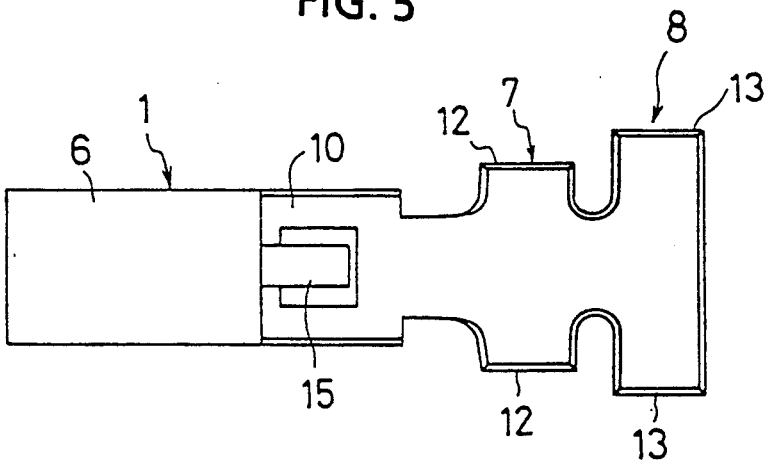
FIG. 5 is a top plan view of the miniature contact terminal.
Figure 6:
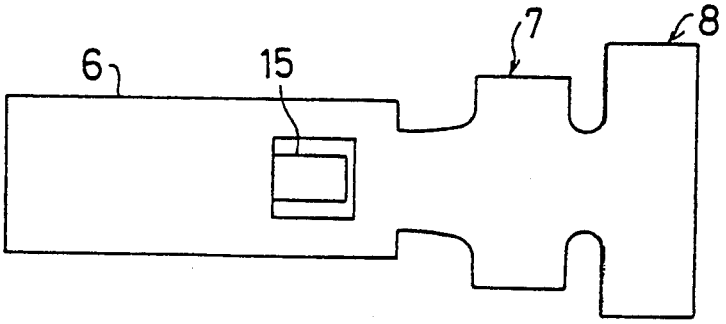
FIG. 6 is a bottom plan view of the miniature contact terminal.

In FIGS. 4–6, the rear portion of the closed barrel 15 is placed within the tool opening 10 and 11.

In order to connect the shielded cable 2 to the contact terminal 1, the front portion of the shielded cable 2 is prepared to expose the signal line (inner conductor) 20, the intermediate insulator 21, and the shield braid (outer conductor) 22 from the outer sheath 23.

The front portion of the shielded cable 2 is placed on the contact terminal 1 such that the signal line 20 is inserted into the closed barrel 15 while the shield braid 22 and the outer sheath 23 rest between the respective crimping tabs 12 and 13.

Figure 7:
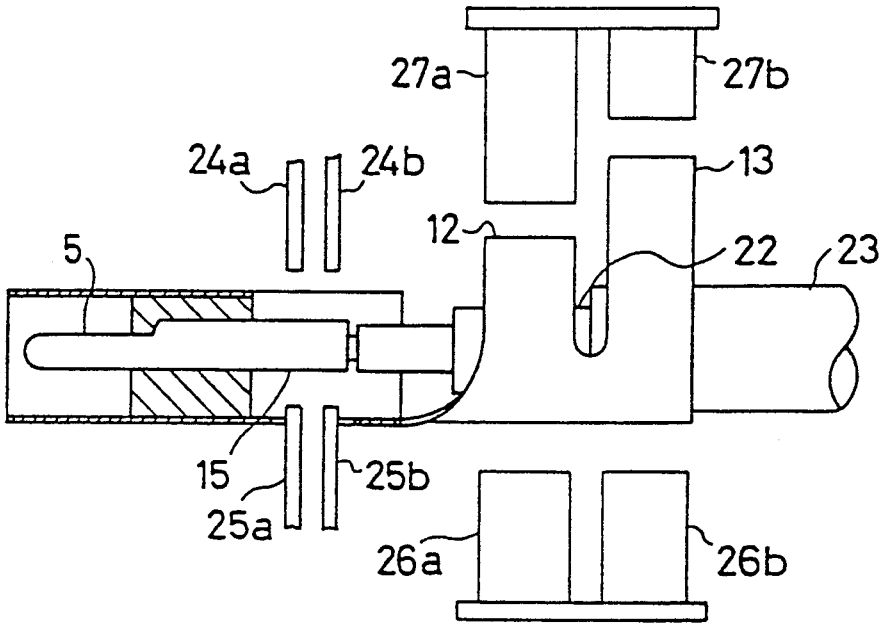
FIG. 7 is a side elevational view of the miniature contact terminal useful for explaining how to connect a shielded cable to the contact terminal.
Figure 8:
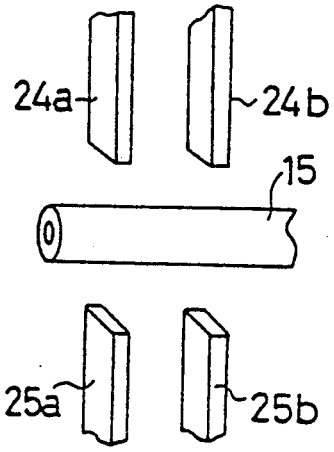
FIG. 8 is a perspective view of a closed barrel to be crimped by the crimper dies.

As FIG. 7 shows, the crimping dies 24*a*, 24*b*, 25*a*, and 25*b* are used to crimp the closed barrel 15 to the signal line 20 while the crimping anvils 26*a* and 26*b* and the crimper dies 27*a* and 27*b* are used to crimp the respective crimping tabs 12 and 13 to the shield braid 22 and the outer sheath 23. That is, the crimping tools 24*a* and 14*b* and the crimping tools 25*a* and 25*b* are inserted through the respective tool openings 10 and 11 to crimp the closed barrel 15 to the signal line 20 as shown in FIG. 8. At the same time, the crimping anvils 26*a* and 26*b* and the crimper dies 27*a* and 27*b* are used to crimp the respective crimping tabs 12 and 13 to the shield braid 22 and the outer sheath 23, thereby connecting the shielded cable 2 to the contact terminal 1. The contact terminal 1 is mounted in a housing to form a female connector B, which is to be connected to a male connector C to conduct current.

Figure 9:
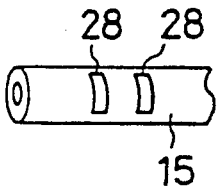
FIG. 9 is a perspective view of the closed barrel after crimping.
Figure 10:
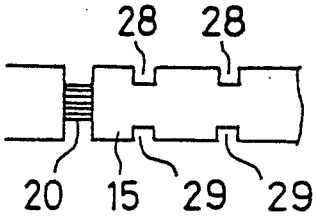
FIG. 10 is a side elevational view of the closed barrel after crimping.

In FIGS. 9 and 10, when the closed barrel 15 is crimped to the signal line 20, press indentations 28 and 29 are formed on the closed barrel 15 with the crimping tools 24*a*, 24*b*, 25*a*, and 25*b*. The crimping tools 24*a*, 24*b*, 25*a*, and 25*b* for the closed barrels are smaller than the crimper dies 61 for the open-barrel type crimping tabs, making it possible to reduce the size of the tool openings 10 and 11 and the width H of the shield jacket 1.

Figure 11:
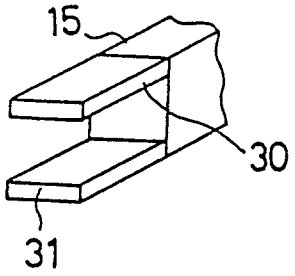
FIG. 11 is a perspective view of a closed barrel according to another embodiment of the invention.

FIG. 11 shows an alternative closed barrel 15 which has a pair of flat pieces 30 and 31 between which the signal line 20 is placed, and the flat pieces 30 and 31 are crimped to the signal line 20 with the crimping tools 24*a*, 24*b*, 25*a*, and 25*b*. That is, the crimper dies are inserted through the respective tool openings to crimp the flat pieces to the signal line while the crimping tabs are crimped to the shield braid and the outer sheath, respectively, with the crimping tools.

With the above signal contact structures, it is possible to make the crimping tools smaller than those of the open barrel type, thereby making it possible to reduce the size of the tool opening and the width of the shield jacket. This makes the miniaturization of the connector possible.

We claim:

1. A miniature electrical contact terminal for a shielded cable having a central conductor comprising:

a shield jacket made from sheet metal to have a contact support section, a pair of opposed tool openings, a U-shaped shield wire crimping section having crimping tabs for crimping a shield wire of said shielded cable, and a U-shaped outer sheath crimping section having crimping tabs for crimping an outer sheath of said shielded cable;

an insulator block fitted in said contact support section; and a signal line contact having a closed barrel fitted through said insulator block such that a rear portion thereof is placed within said tool openings, whereby said rear portion of said closed barrel, said shield wire crimping section, and said outer sheath crimping section are crimped simultaneously to said central conductor, said shield wire, and said outer sheath of said shielded cable, respectively.

2. The miniature electrical contact of claim 1, wherein said rear portion of said closed barrel is crimped at least two places on each of opposite sides of said rear portion with two pairs of narrow flat-plate like crimping dies.

3. A miniature electrical contact terminal for a shielded cable having a central conductor comprising:

a shield jacket made from sheet metal to have a contact support section, a pair of opposed tool openings, a U-shaped shield wire crimping section having crimping tabs for crimping a shield wire of said shielded cable, and a U-shaped outer sheath crimping section having crimping tabs for crimping an outer sheath of said shielded cable;

an insulator block fitted in said contact support section; and a signal line contact having a closed barrel fitted through said insulator block such that a pair of opposed flat pieces extending from a rear end thereof in the axial direction is placed within said tool openings, whereby said flat pieces, said shield braid crimping section, and said outer sheath crimping section are crimped simultaneously to said central conductor, said shield wire, and said outer sheath of said shielded cable, respectively.

* * * * *